US010578322B2

(12) United States Patent
Sato

(10) Patent No.: US 10,578,322 B2
(45) Date of Patent: Mar. 3, 2020

(54) OUTDOOR UNIT OF AIR CONDITIONER

(71) Applicant: Samsung Electronics Co., Ltd., Suwon-si, Gyeonggi-do (KR)

(72) Inventor: Seiji Sato, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/759,180

(22) PCT Filed: Sep. 9, 2016

(86) PCT No.: PCT/KR2016/010194
§ 371 (c)(1),
(2) Date: Mar. 9, 2018

(87) PCT Pub. No.: WO2017/043927
PCT Pub. Date: Mar. 16, 2017

(65) Prior Publication Data

US 2018/0259201 A1 Sep. 13, 2018

(30) Foreign Application Priority Data

Sep. 11, 2015 (JP) ..... 2015-179119

(51) Int. Cl.
*F24F 1/38* (2011.01)
*F24F 13/20* (2006.01)
(Continued)

(52) U.S. Cl.
CPC ..... *F24F 1/38* (2013.01); *F04D 29/54* (2013.01); *F04D 29/542* (2013.01); *F24F 1/56* (2013.01); *F24F 13/20* (2013.01)

(58) Field of Classification Search
CPC ..... F24F 1/38; F24F 1/56; F24F 13/20; F24F 2013/205; F24F 13/081; F24F 13/082; F04D 29/542
See application file for complete search history.

(56) References Cited

U.S. PATENT DOCUMENTS 2,920,464 A * 1/1960 Trask ..... F24F 1/38 165/122
3,079,766 A * 3/1963 Abbott ..... F24F 1/02 261/79.2

(Continued)

FOREIGN PATENT DOCUMENTS

JP 2015129504 A 7/2015
KR 10-0408781 B1 12/2003

(Continued)

OTHER PUBLICATIONS

ISA/KR, International Search Report and Written Opinion of the International Searching Authority, International Application No. PCT/KR2016/010194, dated Nov. 17, 2016, 14 pages.

*Primary Examiner* — Nelson J Nieves

(57) ABSTRACT

The present invention is provided to improve static pressure efficiency in an air blower provided with a fixed blade on the downstream side of a fan. The air blower includes: a fan which rotates in a predetermined direction around a rotational axis; and a plurality of fixed blades which are arranged radially around the rotational axis on the downstream side in the advancing direction of an airflow generated by the rotation of the fan and are curved in the opposite direction to the rotation direction of the fan from an inner circumferential part toward an outer circumferential part, wherein the fixed blades are configured in such a manner that an inlet angle formed between an inlet end through which the airflow flows and the rotational axis, and a chord angle formed between a chord connecting the inlet end to an outlet end through which the airflow is discharged and the rotating axis, are greater in the inner circumferential part and the outer circumferential part than in the radial center portion, and an outflow angle formed between the outlet end and the rotational axis is greater than 0° and less than 50°.

9 Claims, 23 Drawing Sheets

(51) Int. Cl.
*F24F 1/56* (2011.01)
*F04D 29/54* (2006.01)

(56) References Cited

U.S. PATENT DOCUMENTS 4,307,778 A * 12/1981 Tobin ..... F24F 1/18 165/125
6,503,060 B1 * 1/2003 Kamada ..... F04D 29/703 415/121.2
6,994,523 B2 2/2006 Eguchi et al.
9,513,021 B2 * 12/2016 Kato ..... F04D 29/162
2003/0021674 A1 * 1/2003 Zeighami ..... F04D 25/166 415/119
2004/0165986 A1 * 8/2004 Parker ..... F04D 29/164 415/220
2005/0260075 A1 * 11/2005 Arinaga ..... F04D 17/06 415/220
2008/0219836 A1 * 9/2008 Decker ..... F04D 29/542 415/177
2009/0226299 A1 * 9/2009 Jin ..... F04D 19/007 415/66
2010/0269537 A1 * 10/2010 Tadokoro ..... F04D 29/526 62/426
2011/0017427 A1 * 1/2011 Kato ..... F04D 29/164 165/59
2011/0174013 A1 * 7/2011 Moraes ..... F24F 1/16 62/498
2012/0039731 A1 * 2/2012 Sadi ..... F04D 29/164 417/423.7
2013/0125579 A1 * 5/2013 Okazawa ..... F24F 1/38 62/507
2014/0245776 A1 * 9/2014 Choi ..... F24F 1/38 62/426
2014/0301825 A1 10/2014 Tian et al.
2015/0044058 A1 * 2/2015 Hamada ..... F04D 29/384 416/242
2015/0125287 A1 * 5/2015 Briand ..... F04D 19/002 415/208.2
2015/0159892 A1 * 6/2015 Jung ..... F04D 29/646 454/338
2015/0184872 A1 * 7/2015 Oh ..... F24F 1/56 165/122
2015/0354598 A1 * 12/2015 Dygert ..... F04D 29/164 415/208.2
2015/0354872 A1 * 12/2015 Cur ..... F24F 1/0003 62/119
2016/0097548 A1 * 4/2016 Wang ..... F04D 25/0613 62/507
2016/0131371 A1 * 5/2016 Aoyama ..... F24F 1/50 165/122
2016/0281739 A1 * 9/2016 Nakagawa ..... F04D 29/544
2017/0122327 A1 * 5/2017 Maier ..... F04D 19/007
2017/0184125 A1 * 6/2017 Matsui ..... F04D 29/38

FOREIGN PATENT DOCUMENTS

KR 10-0566501 B1 3/2006
KR 10-2015-0101773 A 9/2015

* cited by examiner

[Fig. 1]
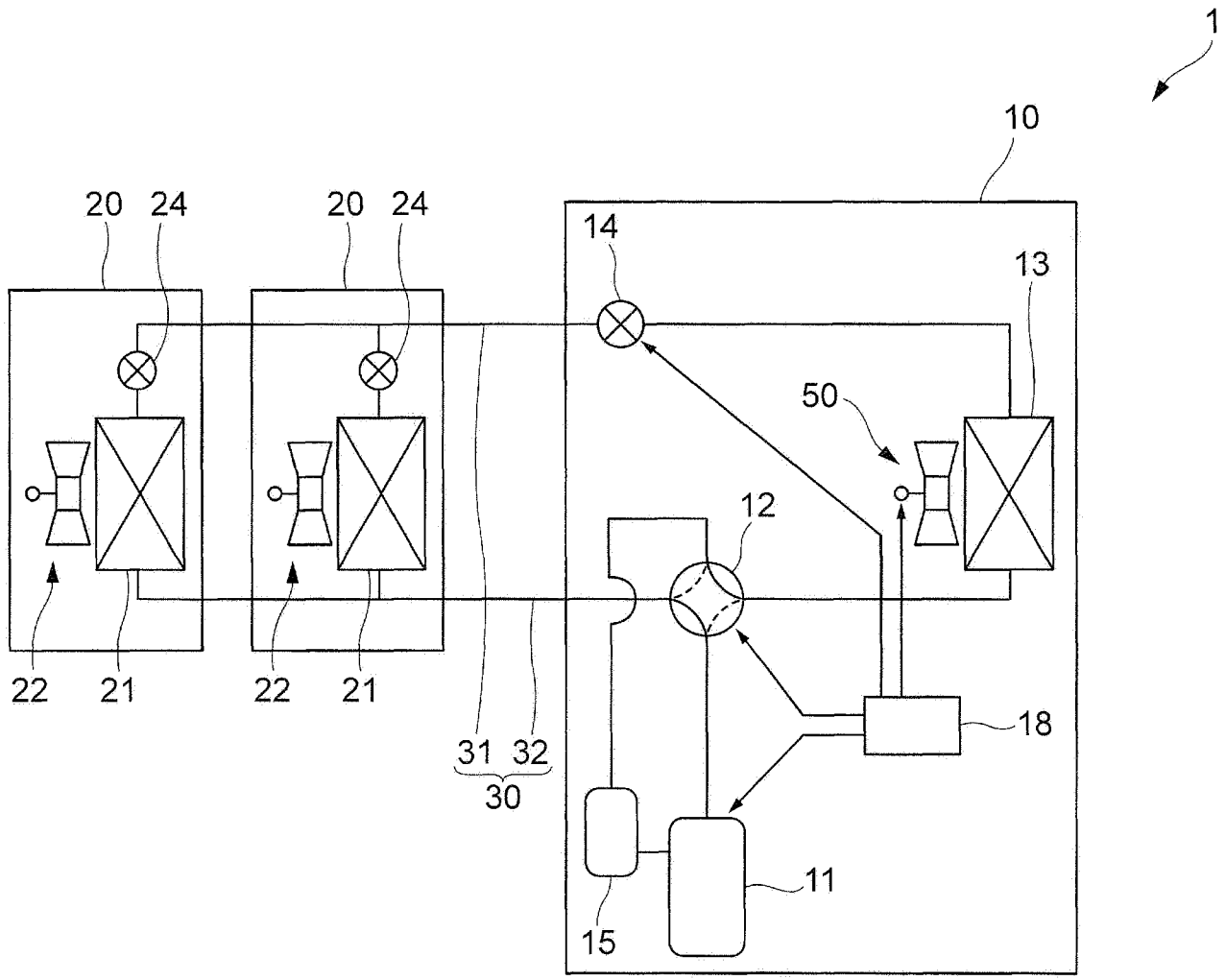

【Fig. 2】
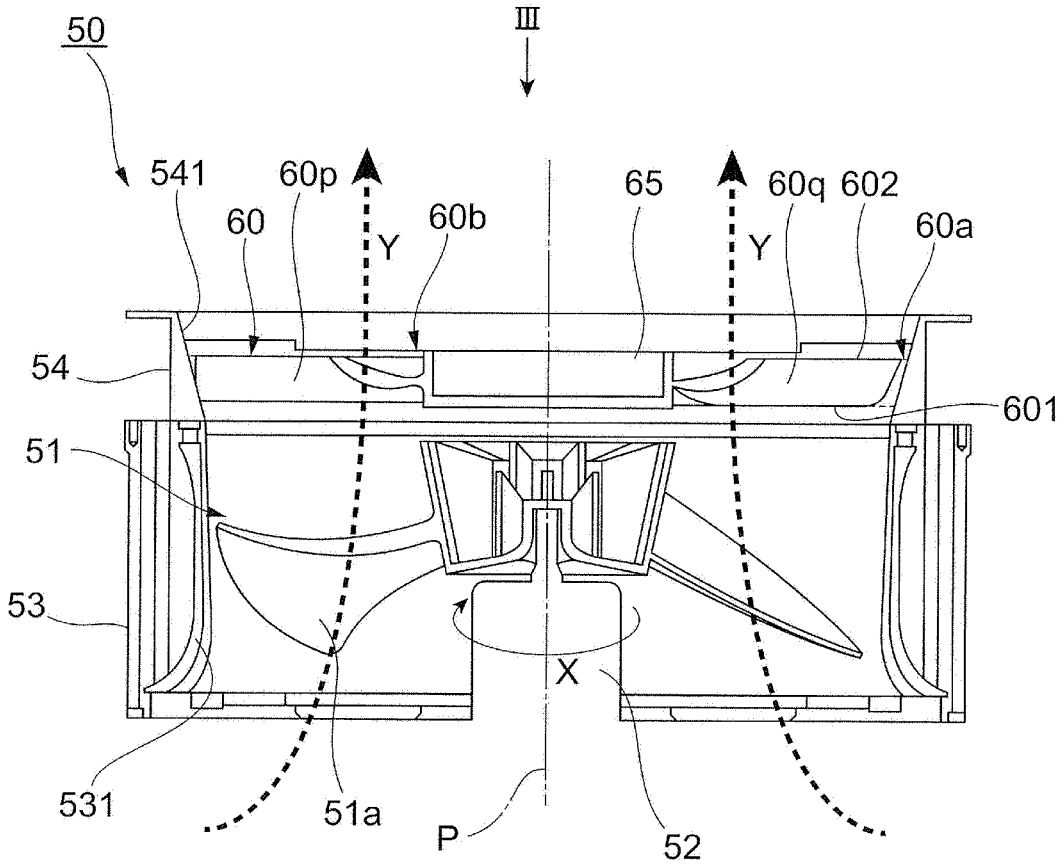

【Fig. 3】
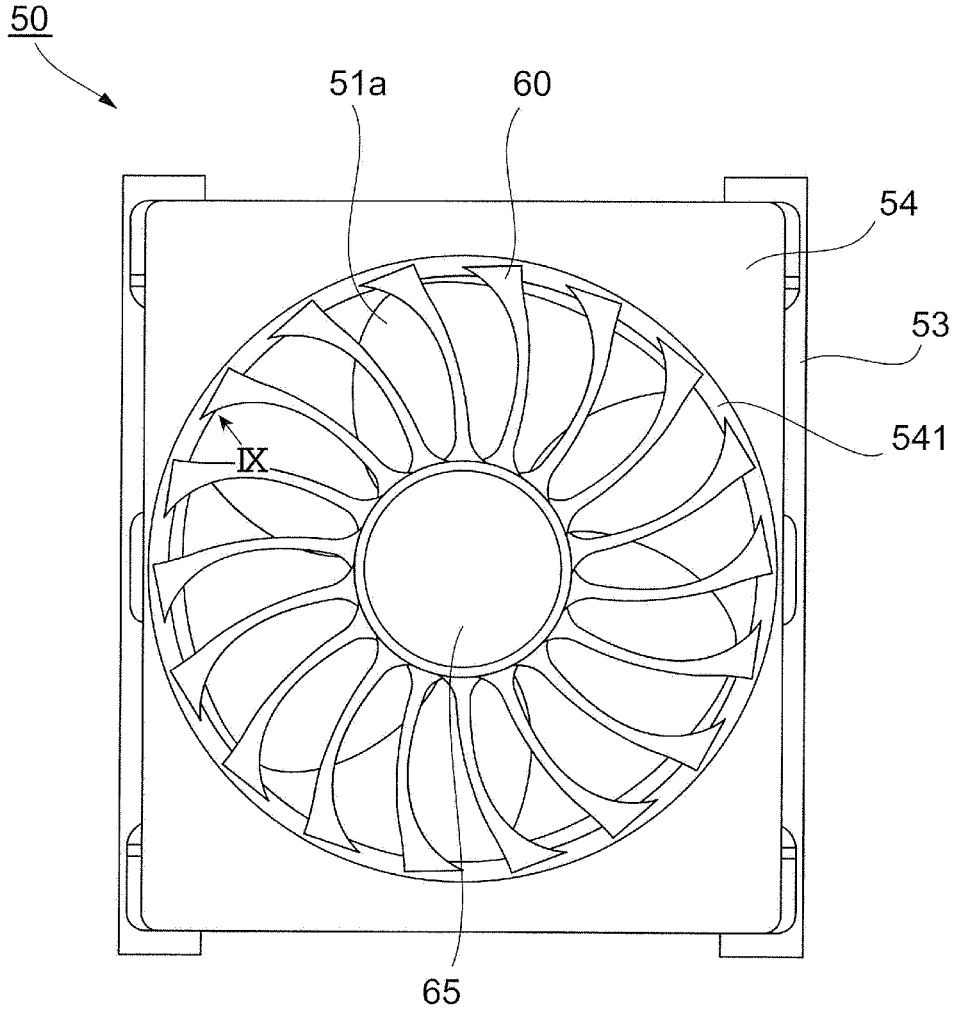

【Fig. 4】
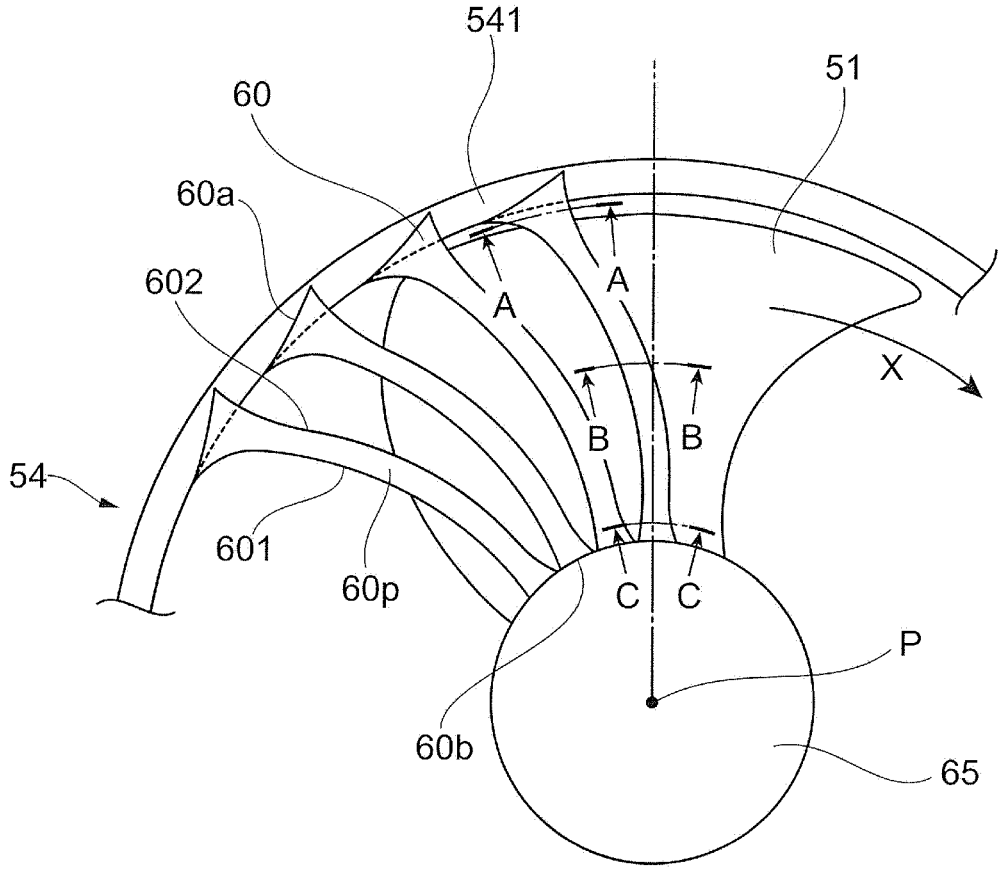

【Fig. 5】
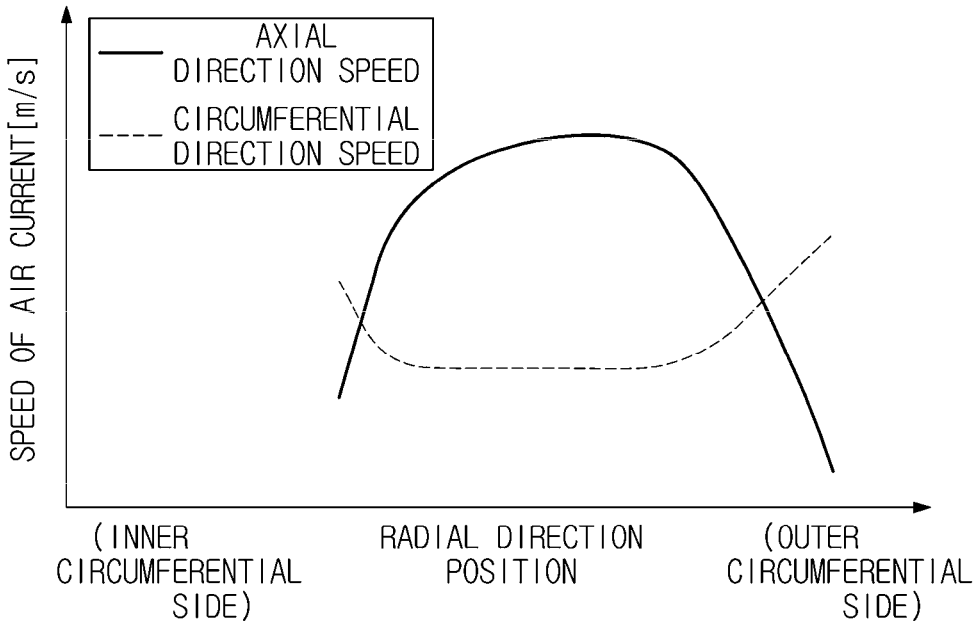

【Fig. 6】
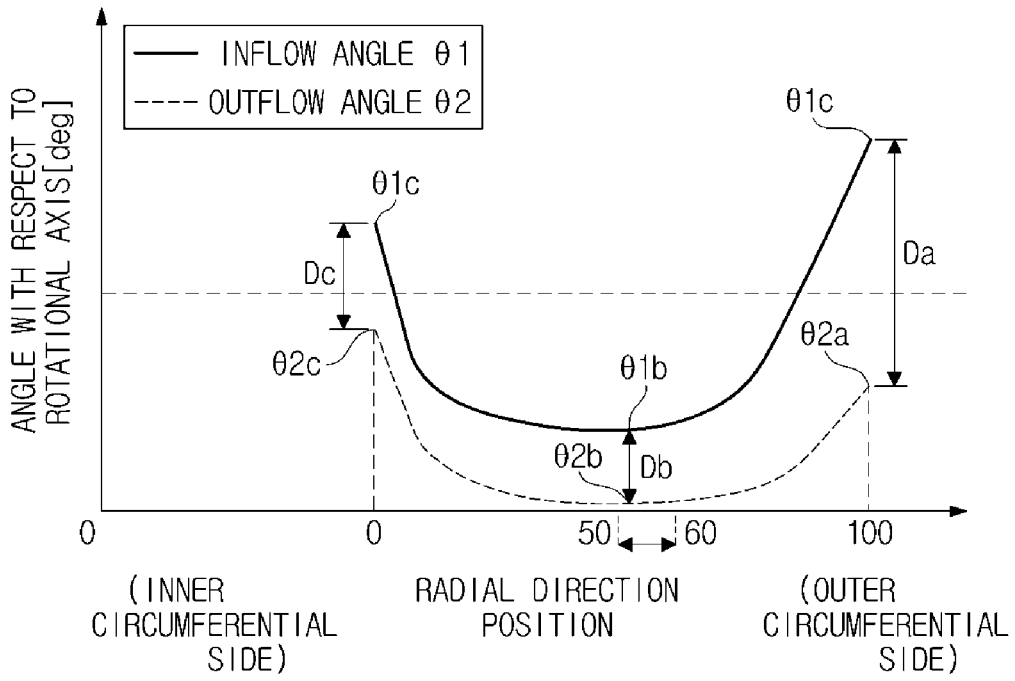

【Fig. 7a】
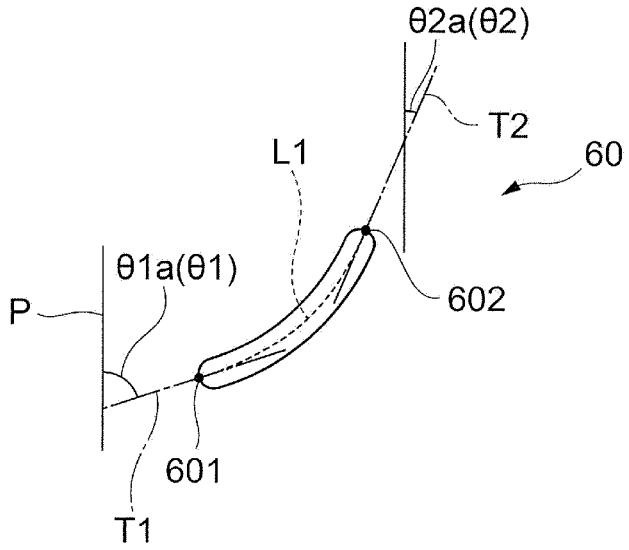

【Fig. 7b】
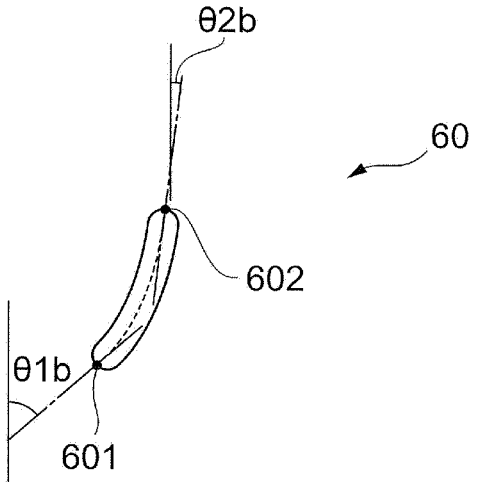

【Fig. 7c】
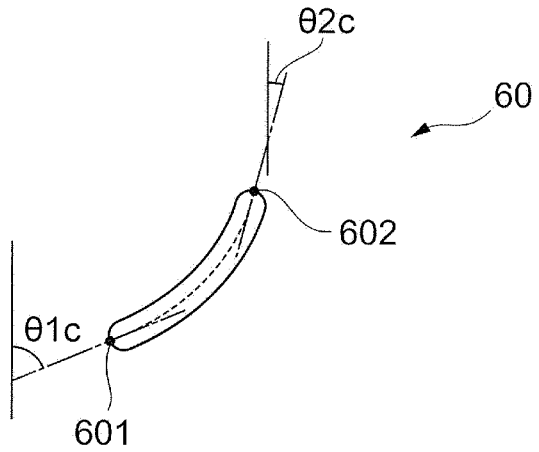

【Fig. 8a】
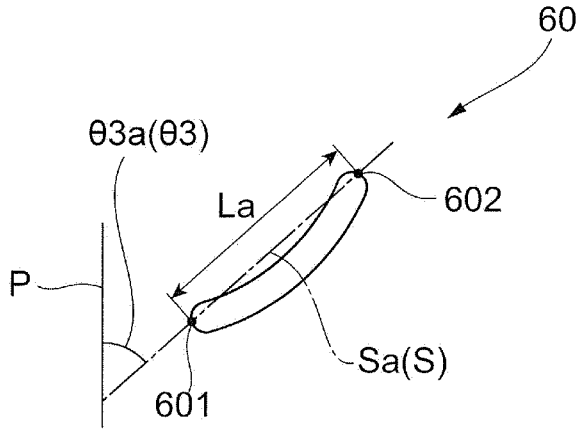

【Fig. 8b】
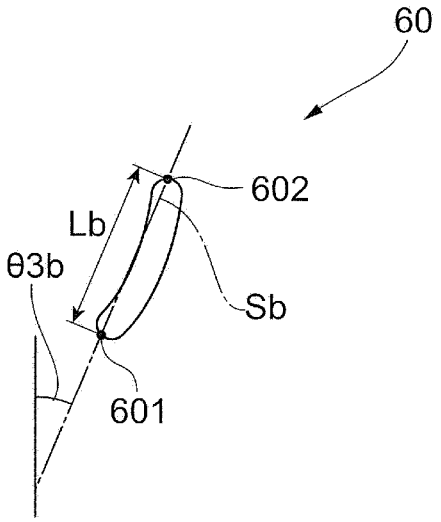

【Fig. 8c】
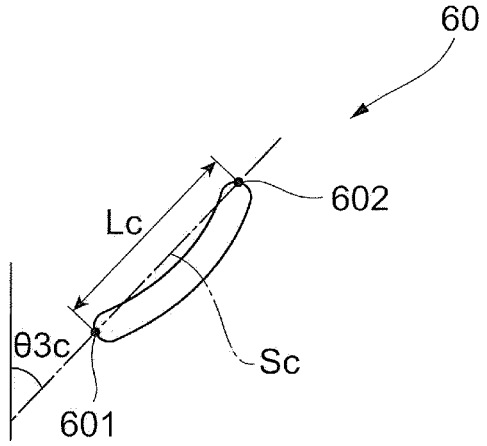

【Fig. 9】
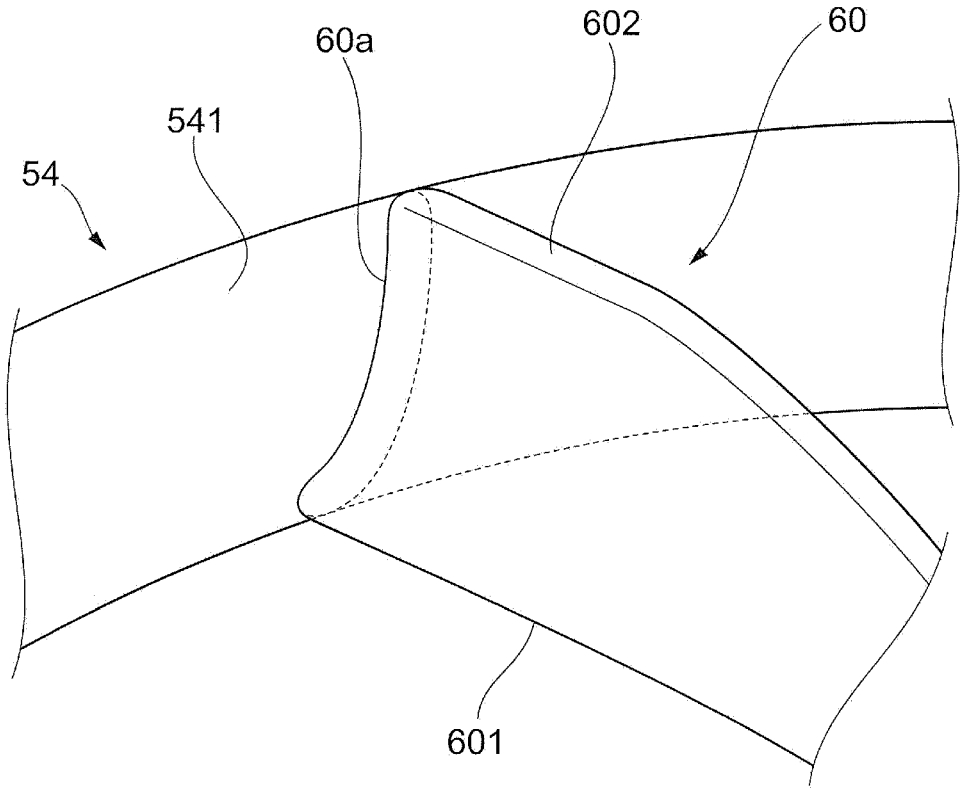

【Fig. 10】
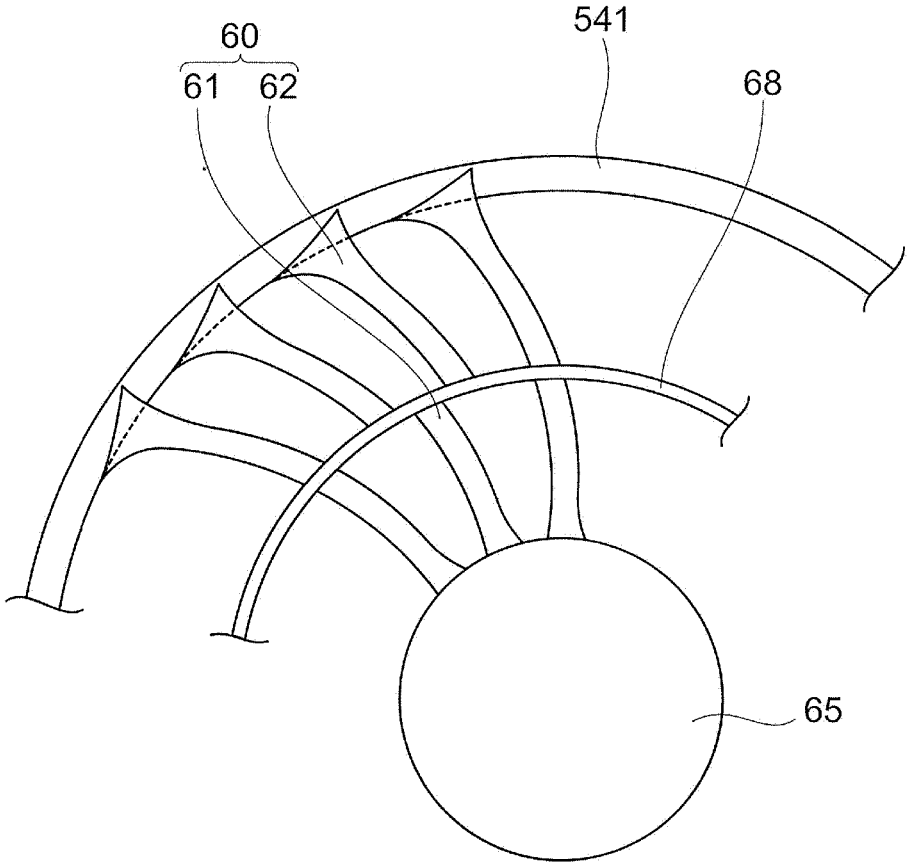

【Fig. 11a】
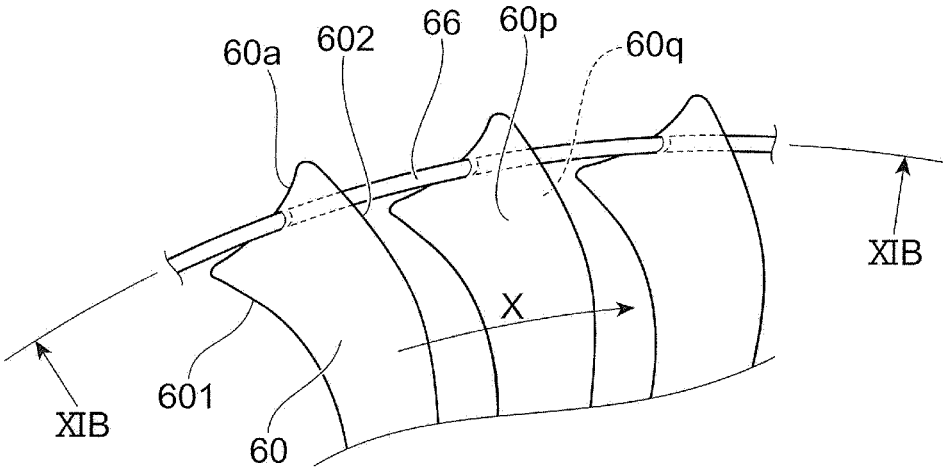

【Fig. 11b】
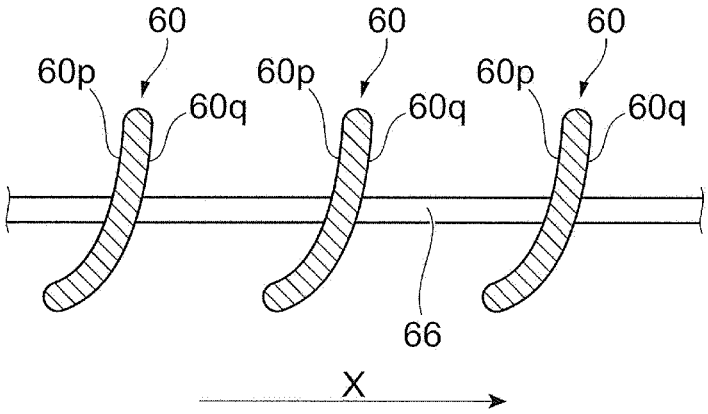

【Fig. 12】
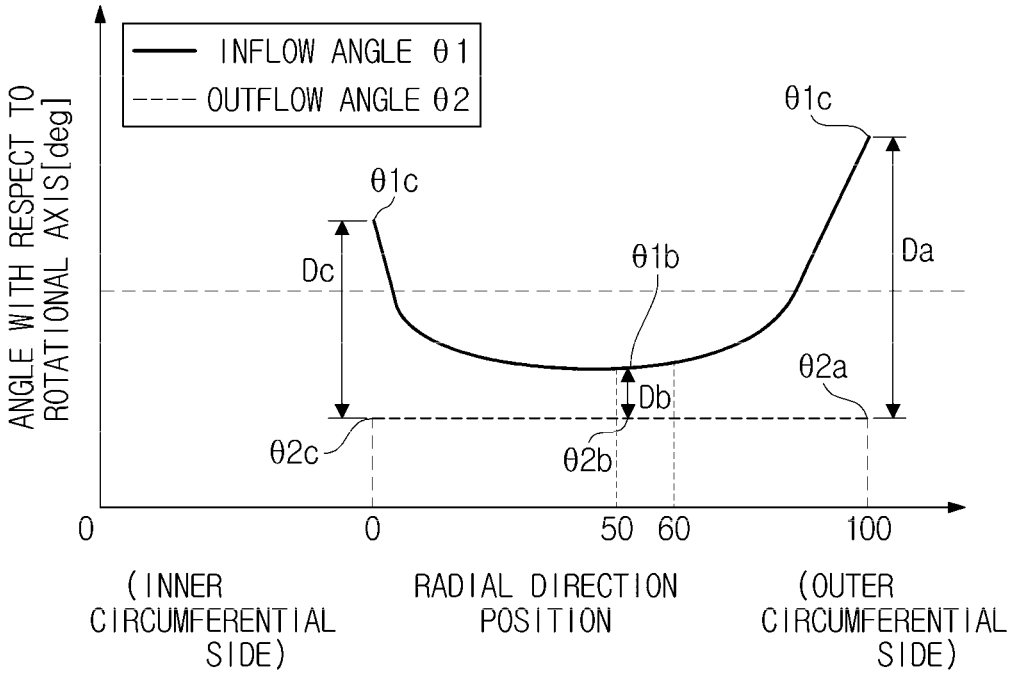

【Fig. 13a】
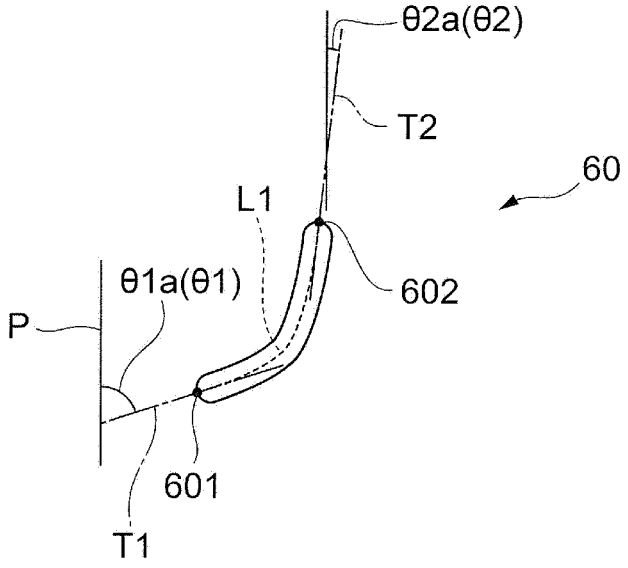

【Fig. 13b】
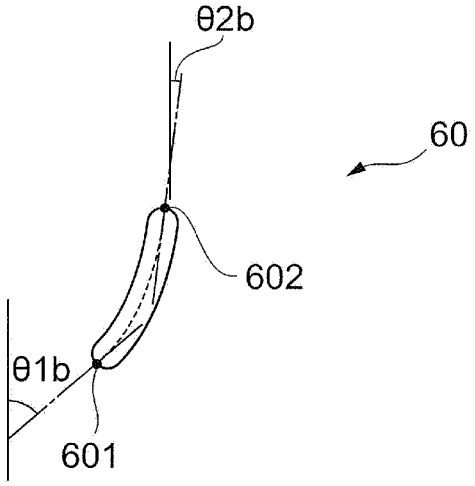

【Fig. 13c】
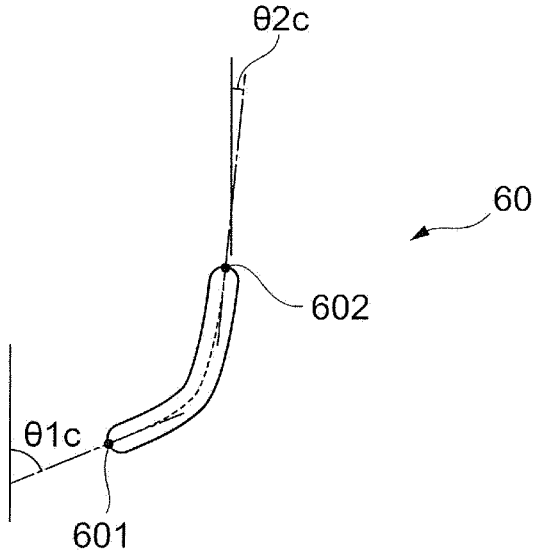

【Fig. 14a】
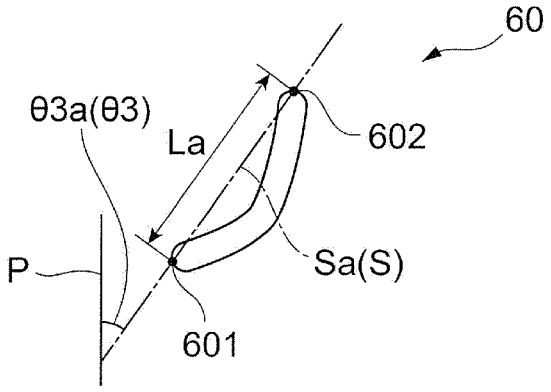

【Fig. 14b】
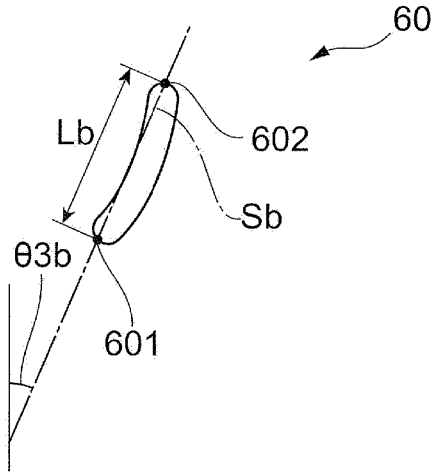

【Fig. 14c】
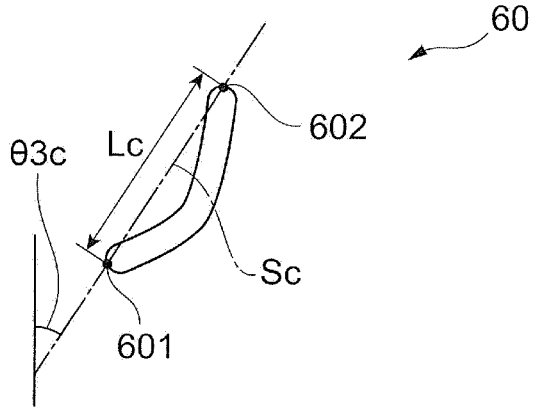

OUTDOOR UNIT OF AIR CONDITIONER

CROSS-REFERENCE TO RELATED APPLICATIONS AND CLAIM OF PRIORITY

This application is a 371 of International Application No. PCT/KR2016/010194, filed Sep. 9, 2016, which claims priority to Japanese Patent Application No. 2015-179119, filed Sep. 11, 2015, the disclosures of which are herein incorporated by reference in their entirety.

TECHNICAL FIELD

The present invention relates to an air conditioner, and more particularly, to an air blower and an outdoor unit.

BACKGROUND

As an air blower used in an outdoor unit of an air conditioner, there exists an air blower which includes a rotating fan with a plurality of rotating blades and a plurality of fixed blades installed at a downstream side of the fan.

As an example, there is disclosed an outdoor unit of an air conditioner which includes a rotating propeller fan and a plurality of radial-shaped crossbars installed at a downstream side of the propeller fan. In this outdoor unit, the radially-shaped crossbars have a shape radiating in a circular arc to be inclined in an axial direction of the propeller fan to have a function of converting dynamic pressure energy of a vortex which flows from the propeller fan into static pressure energy and collecting the static energy.

SUMMARY

However, an air current generated by rotation of a fan which includes a plurality of fixed blades generally has different jet directions according to positions in a radial direction of the fan. Also, since it is impossible to efficiently collect a dynamic pressure of the air current generated by the rotation of the fan depending on a difference in shapes of fixed blades installed at a downstream side of the fan, static pressure efficiency of the air blower may be decreased.

The present invention is directed to increasing static pressure efficiency in an air blower with fixed blades installed at a downstream side of a fan.

One aspect of the present invention provides an air blower including a fan which rotates in a predetermined direction around a rotational axis, and a plurality of fixed blades which are arranged radially around the rotational axis on a downstream side in an advancing direction of an airflow generated by the rotation of the fan and are curved on an opposite side to the rotation direction of the fan from an inner circumferential part toward the outer circumferential part, wherein the fixed blades are configured in such a manner whereby an inflow angle formed between an inlet end through which the airflow flows and the rotational axis, and a chord angle formed between an outlet end through which the airflow is discharged and a chord connected to the inlet end, are greater in the inner circumferential part and the outer circumferential part than in a radial center part, and an outflow angle formed between an outlet end and the rotational axis is greater than 0° and 50° or less.

The fixed blades may have the outflow angle, which is greater in the inner circumferential part and the outer circumferential part than in the radial center part.

The fixed blades may have the outflow angle which is approximately uniform throughout the inner circumferential part and the outer circumferential part.

The fixed blades may have the chord, which is longer in the inner circumferential part and the outer circumferential part than in the radial center part.

The air blower may further include an outer circumferential connection member which connects outer circumferential ends of the fixed blades adjacent in the rotational direction of the fan.

The air blower may further include a first accommodation member which has a bell mouth shape with a cross section increasing from the downstream side to the upstream side in the advancing direction of the air current generated by the fan and accommodates the fan, and a second accommodation member which has a cylindrical shape with an inner diameter equal to or greater than an inner diameter of the first accommodation member at the downstream side in the advancing direction, is connected to the first accommodation member at the downstream side in the advancing direction, and supports outer circumferential parts of the plurality of fixed blades.

Another aspect of the present invention provides an air blower including a fan which rotates in a predetermined direction around a rotational axis, and a plurality of fixed blades which are arranged radially around the rotational axis on a downstream side in an advancing direction of an airflow generated by the rotation of the fan and are curved on an opposite side to the rotation direction of the fan from an inner circumferential part toward the outer circumferential part, wherein the fixed blades are configured in such a manner whereby an inflow angle formed between an inlet end through which the airflow flows and the rotational axis, and a chord angle formed between an outlet end through which the airflow is discharged and a chord connected to the inlet end, are greater in the inner circumferential part and the outer circumferential part than in a radial center part, and an outflow angle formed between an outlet end and the rotational axis is approximately uniform throughout the inner circumferential part and the outer circumferential part.

Still another aspect of the present invention provides an outdoor unit including a compressor which compresses a refrigerant, a heat exchanger which moves heat of the refrigerant, and an air blower which blows air for transferring heat between the heat exchanger and the air. Here, the air blower includes a fan which rotates in a predetermined direction around a rotational axis, and a plurality of fixed blades which are arranged radially around the rotational axis on a downstream side in an advancing direction of an airflow generated by the rotation of the fan and are curved on an opposite side to the rotation direction of the fan from an inner circumferential part toward the outer circumferential part, wherein the fixed blades are configured in such a manner whereby an inflow angle formed between an inlet end through which the airflow flows and the rotational axis, and a chord angle formed between an outlet end through which the airflow is discharged and a chord connected to the inlet end, are greater in the inner circumferential part and the outer circumferential part than in a radial center part, and an outflow angle formed between an outlet end and the rotational axis is greater than 0° and 50° or less.

Yet another aspect of the present invention provides an outdoor unit including a compressor which compresses a refrigerant, a heat exchanger which moves heat of the refrigerant, and an air blower which blows air for transferring heat between the heat exchanger and the air. Here, the air blower includes a fan which rotates in a predetermined direction around a rotational axis, and a plurality of fixed blades which are arranged radially around the rotational axis on a downstream side in an advancing direction of an airflow generated by the rotation of the fan and are curved on an opposite side to the rotation direction of the fan from an inner circumferential part toward the outer circumferential part, wherein the fixed blades are configured in such a manner whereby an inflow angle formed between an inlet end through which the airflow flows and the rotational axis, and a chord angle formed between an outlet end through which the airflow is discharged and a chord connected to the inlet end, are greater in the inner circumferential part and the outer circumferential part than in a radial center part, and an outflow angle formed between an outlet end and the rotational axis is approximately uniform throughout the inner circumferential part and the outer circumferential part.

According to the present invention, it becomes possible to increase static pressure efficiency in an air blower with fixed blades installed at a downstream side of a fan.

BRIEF DESCRIPTION OF THE DRAWINGS

FIG. 1 is a schematic configuration diagram of an air conditioner to which the embodiment is applied.

FIG. 2 is a schematic cross-sectional view illustrating components of the air blower to which the embodiment is applied.

FIG. 3 is a schematic cross-sectional view illustrating components of the air blower to which the embodiment is applied.

FIG. 4 is a view illustrating a relationship between the fixed blades and the fan, to which Embodiment 1 is applied.

FIG. 5 is a view illustrating a radial distribution of a speed of the air current generated by rotation of the fan according to Embodiment 1.

FIG. 6 is a view illustrating changes of an inflow angle an outflow angle of the fixed blade, to which Embodiment 1 is applied.

FIGS. 7A to 7C are views illustrating shapes of a cross section of the fixed blade to which Embodiment 1 is applied.

FIGS. 8A to 8C are views illustrating shapes of a cross section of the fixed blade to which Embodiment 1 is applied.

FIG. 9 is a relationship between the fixed blade of Embodiment 1 and an inner wall surface of the second housing and is a view seen in an IX direction in FIG. 3.

FIG. 10 is a view illustrating a configuration of the fixed blade to which Modified Example 1 of Embodiment 1 is applied.

FIGS. 11A and 11B are views illustrating a configuration of the fixed blade to which Modified Example 2 of Embodiment 1 is applied.

FIG. 12 is a view illustrating changes of an inflow angle an outflow angle of the fixed blade, to which Embodiment 2 is applied.

FIGS. 13A to 13C are views illustrating shapes of a cross section of the fixed blade to which Embodiment 2 is applied.

FIGS. 14A to 14C are views illustrating shapes of a cross section of the fixed blade to which Embodiment 2 is applied.

DETAILED DESCRIPTION

Embodiment 1

Hereinafter, embodiments of the present invention will be described in detail with reference to the attached drawings.

FIG. 1 is a schematic configuration diagram of an air conditioner 1 to which Embodiment 1 is applied.

The air conditioner 1 includes an outdoor unit 10 installed on, for example, a rooftop and the like of a building, a plurality of indoor units 20 installed in sections of the building, and a pipe 30 connected between the outdoor unit 10 and the indoor units 20 and through which a refrigerant circulating in the outdoor unit 10 and the indoor units 20 flows.

The outdoor unit 10 includes a compressor 11 which compresses a refrigerant, a 4-way conversion valve 12 which converts a flow path of the refrigerant, an outdoor heat exchanger 13 which transfers heat from an object of a high temperature to an object of a low temperature, an outdoor expansion valve 14 which expands and evaporates the compressed refrigerant so that the compressed refrigerant is at a low pressure and a low temperature, and an accumulator 15 which separates the residual refrigerant which is not evaporated and remains. Also, the outdoor unit 10 includes an air blower 50 which jets air to the outdoor heat exchanger 13 to promote heat exchange between a refrigerant and the air. The 4-way conversion valve 12 is connected to the compressor 11, the outdoor heat exchanger 13, and the accumulator 15 through pipes. Also, the compressor 11 and the accumulator 15 are connected through pipes, and the outdoor heat exchanger 13 and the outdoor expansion valve 14 are connected through pipes. Also, FIG. 1 illustrates a conversion and connection state of the 4-way conversion valve 12, which is a state when a heating operation is performed.

Also, the outdoor unit 10 includes a control device 18 which controls operations of the compressor 11, the outdoor expansion valve 14, the air blower 50, and the like or conversion of the 4-way conversion valve 12.

As shown in FIG. 1, the indoor unit 20 includes an indoor heat exchanger 21 which moves heat from an object of a low temperature to an object of a high temperature thereinside, an air blower 22 which promotes heat exchange between a refrigerant and air by jetting the air to the indoor heat exchanger 21, and an indoor expansion valve 24 which expands and evaporates a compressed refrigerant solution so that the compressed refrigerant solution is at a low pressure and a low temperature.

Also, although two indoor units 20 are connected to one outdoor unit 10 in an example shown in FIG. 1, one or three indoor units 20 may be connected or a plurality of such outdoor units 10 may be present.

The pipe 30 includes a liquid refrigerant pipe 31 through which a liquefied refrigerant flows and a gas refrigerant pipe 32 through which a gas refrigerant flows. The liquid refrigerant pipe 31 is disposed to allow a refrigerant to flow between the indoor expansion valve 24 of the indoor unit 20 and the outdoor expansion valve 14. The gas refrigerant pipe 32 is disposed to allow a refrigerant to flow between the 4-way conversion valve 12 of the outdoor unit 10 and a gas side of the indoor heat exchanger 21 of the indoor unit 20.

Subsequently, the air blower 50 according to the embodiment will be described. FIG. 2 is a schematic cross-sectional view illustrating components of the air blower 50 to which Embodiment 1 is applied. Also, FIG. 3 is a schematic top view illustrating components of the air blower 50 to which Embodiment 1 is applied and corresponds to a view of the air blower 50 in FIG. 2 seen from a direction III.

The air blower 50 according to the embodiment includes a fan 51 which rotates around a rotational axis P in a direction of an arrow X to generate an air current for cooling the outdoor heat exchanger 13 (refer to FIG. 13), a motor 52 which rotationally drives the fan 51, a first housing 53 as an example of a first accommodation member which accommodates the motor 52, and a second housing 54 as an example of a second accommodation member connected to the first housing 53 at a downstream side of a movement direction of the air current generated by the fan 51. In the embodiment, as shown in FIG. 3, the fan 51 includes three rotating blades 51*a*.

Here, the air blower 50 according to the embodiment is installed to allow a rotational axis direction of the fan 51 to be in a vertical direction. Also, although not shown in the drawing, in the embodiment, the above-described outdoor heat exchanger 13 is installed to be vertically below the first housing 53 of the air blower 50. Also, in the air blower 50 according to the embodiment, air is suctioned in from a nearby region of the outdoor heat exchanger 13 by rotation of the fan 51, and an air current vertically flows from bottom to top as shown by dashed arrow Y.

The first housing 53 according to the embodiment includes a cylindrical-shaped inner wall surface 531, and a flow path through which the air current generated by the fan 51 passes is formed by the inner wall surface 531 in the first housing 53. In the first housing 53 according to the present invention, as shown in FIG. 2, the flow path formed by the inner wall surface 531 is formed to have a so-called bell mouth shape which has a cross section enlarging from the downstream side of the movement direction of the air current (a top side in FIG. 2) toward an upstream side of the movement direction of the air current (a bottom side in FIG. 2).

Also, the second housing 54 according to the embodiment includes a cylindrical inner wall surface 541, and a flow path (an outlet duct) through which an air current which has passed through the first housing 53 is formed by the inner wall surface 541 in the second housing 54. In the second housing 54 according to the present invention, as shown in FIG. 2, the flow path formed by the inner wall surface 541 is formed to have an expanding shape which has a cross section enlarging from the upstream side of the movement direction of the air current (the bottom side in FIG. 2) to the downstream side of the movement direction of the air current (the top side in FIG. 2).

In the embodiment, an inner diameter of the inner wall surface 541 of the second housing 54 is the same as or greater than an inner diameter of the inner wall surface 531 of the first housing 53 at the downstream side of the movement direction of the air current. Due to this, for example, in comparison to a case in which the diameter of the inner wall surface 541 of the second housing 54 is smaller than the inner diameter of the inner wall surface 531 of the first housing 53 at the downstream side of the movement direction of the air current, the air current may easily flow while passing through a space surrounded by the inner wall surface 541 and a fixed blade 60 which will be described below.

Also, the second housing 54 according to the embodiment includes a plurality of such fixed blades 60 which stretches from the inner wall surface 541 toward the rotational axis P and includes an inner circumferential connection member 65 installed near the rotational axis P and to which the plurality of fixed blades 60 are connected. In other words, as shown in FIG. 2, the second housing 54 according to the embodiment includes the plurality of fixed blades 60 installed to radiate from the inner circumferential connection member 65 toward the inner wall surface 541. Here, each of the fixed blades 60 has a plate shape having an approximately uniform thickness throughout from the inner circumferential connection member 65 side to the inner wall surface 541. Also, the plurality of fixed blades 60 according to the embodiment has the same shape. In a following description, a surface of the plate-shaped fixed blade 60, which faces an upstream side of a rotational direction X of the fan 51, is referred to as a first surface 60*p*, and a surface opposite the first surface 60*p* is referred to as a second surface 60*q* (refer to FIG. 7A). In the embodiment, the first surface 60*p* and the second surface 60*q* of adjacent fixed blades 60 face each other with a space interposed therebetween through which an air current passes.

Also, although specification will be given below, in the air blower 50 according to the embodiment, an air current generated by rotation of the fan 51 and jet from the first housing 53 passes through a gap between the plurality of fixed blades 60 formed at the second housing 54 and is discharged outward from the air blower 50.

Here, in the fixed blade 60, an edge of a side opposite the fan 51 and through which the air current generated by rotation of the fan 51 flows in is referred to as an inlet end 601 and an edge of a side positioned opposite the inlet end 601 and through which the air current is discharged is referred to as an outlet end 602. That is, when the air current flows along the fixed blade 60, an edge of an inlet of the fixed blade 60, through which air current flows in, becomes the inlet end 601 and an edge of an outlet through which the air current is discharged from the fixed blade 60 along the fixed blade 60 becomes the outlet end 602. Also, in the fixed blade 60, an edge of an outer circumferential side connected to the inner wall surface 541 of the second housing 54 is referred to as an outer circumference 60*a*, and an edge of an inner circumferential side connected to the inner circumferential connection member 65 is referred to as an inner circumference 60*b*.

FIG. 4 is a view illustrating a relationship between the fixed blades 60 and the fan 51, to which Embodiment 1 is applied, and corresponds to a view seen from the downstream side in the rotational axis direction of the fan 51.

As shown in FIG. 4, from an inner circumferential part connected to the inner circumferential connection member 65 toward an outer circumferential part connected to the inner wall surface 541, each of the fixed blades 60 has a shape curved away from the rotational direction X of the fan 51 to allow a central part thereof to be convex in a radial direction when seen from the downstream side of the rotational axis direction. That is, as shown in FIG. 4, each of the fixed blades 60 has a shape curved away from the rotational direction X of the fan 51, rather than being in a straight line (dashed line of FIG. 4), passes through a rotational center (the rotational axis P) of the fan 51 and a connection portion between the fixed blade 60 and the inner circumferential connection member 65, and stretches toward the inner wall surface 541.

Also, as shown in FIG. 4, each of the fixed blades 60 is installed such that the outlet end 602 deviates from the inlet end 601 in the rotational direction X when seen from the downstream side of the rotational axis direction. That is, each of the fixed blades 60 has a shape which is inclined in the rotational direction X from the inlet end 601 toward the outlet end 602.

Also, throughout the specification, a direction from the bottom to the top in FIG. 2, as a direction according to the rotational axis P of the fan 51, may be simply called a rotational axis direction. Also, a direction from the rotational axis P toward the inner wall surface 531 or the inner wall surface 541, as a direction perpendicular to the rotational axis direction, may be referred to as a radial direction. Also, a radial inside (rotational axis P side) of the fan 51, the fixed blade 60, or the like is sometimes referred to as an inner circumferential side (an inner circumferential part), and a radial outside (the inner wall surface 531 or 541 side) is sometimes referred to as an outer circumferential side (an outer circumferential part).

Subsequently, the air current generated by rotation of the fan 51 will be described. FIG. 5 is a view illustrating a radial distribution of a speed of the air current generated by rotation of the fan 51 according to Embodiment 1. In detail, FIG. 5 illustrates a radial distribution of a speed of an air current in an axial direction, which is generated by rotation of the fan 51 and jet from the first housing 53, and a speed thereof in a circumferential direction.

In the embodiment, the air current generated by rotation of the fan 51 spirally jets from the first housing 53. That is, the air current generated by rotation of the fan 51 has a circumferential direction component which faces the rotational direction X in addition to an axial direction component which faces the downstream side of the rotational axis direction. In FIG. 5, in the air current generated by rotation of the fan 51, a speed of the axial direction component is referred to as an axial direction speed, and a speed of the circumferential direction component is referred to as a circumferential direction speed.

As shown in FIG. 5, in the embodiment, at the inner circumferential part and the outer circumferential part of the air blower 50, the axial direction speed of the air current generated by rotation of the fan 51 is lower than that in a radial direction at a central part located between the inner circumferential part and the outer circumferential part. Also, at the inner circumferential part and the outer circumferential part, the circumferential direction speed of the air current generated by rotation of the fan 51 is higher in comparison to that at the central part in the radial direction.

That is, the air current jets from the inner circumferential part and the outer circumferential part of the first housing 53 have a larger amount of the circumferential direction components in comparison to those of the air current jet from the central part of the first housing 53 in the radial direction. Also, in the air blower 50 according to the embodiment, the air current jets from the inner circumferential part and the outer circumferential part of the first housing 53 are inclined in the rotational direction X (circumferential direction) of the fan 51, in contrast to the air current jet from the central part of the first housing 53 in the radial direction.

Subsequently, a shape of the fixed blade 60 according to the embodiment will be described in detail.

FIG. 6 is a view illustrating changes of an inflow angle θ1 and an outflow angle θ2 of the fixed blade 60 to which Embodiment 1 is applied, according to radial direction positions. Also, FIGS. 7A to 8C are views illustrating shapes of a cross section of the fixed blade 60 to which Embodiment 1 is applied and illustrate shapes of the cross section of the fixed blade 60 according to the rotational direction X of the fan 51. Here, FIGS. 7A and 8A correspond to an A-A cross section in FIG. 4 and illustrate shapes of a cross section at the outer circumferential part of the fixed blade 60. Also, FIGS. 7B and 8B correspond to a B-B cross section in FIG. 4 and illustrate shapes of a cross section at the central part of the fixed blade 60 in the radial direction. Also, FIGS. 7C and 8C correspond to a C-C cross section in FIG. 4 and illustrate shapes of a cross section at the inner circumferential part of the fixed blade 60.

In the embodiment, the inflow angle θ1 of the fixed blade 60 refers to an angle formed by the inlet end 601 of the fixed blade 60 and the rotational axis P of the fan 51, and the outflow angle θ2 of the fixed blade 60 refers to an angle formed by the outlet end 602 of the fixed blade 60 and the rotational axis P of the fan 51.

In detail, as shown in FIG. 7A, in the cross section of the fixed blade 60, a central line L1 which passes through a center of thickness of the fixed blade 60 from the inlet end 601 to the outlet end 602. As described above, the fixed blade 60 has a plate shape which has an approximately uniform thickness and is curved from the inlet end 601 to the outlet end 602. Corresponding thereto, the central line L1 is a curved line which is curved as shown in FIG. 7A.

In the embodiment, in the cross section of the fixed blade 60, an angle formed by a tangent T1 of the central line L1 and the rotational axis P at the inlet end 601 is referred to as the inflow angle θ1. Likewise, in the cross section of the fixed blade 60, an angle formed by a tangent T2 of the central line L1 and the rotational axis P at the outlet end 602 is referred to as the outflow angle θ2.

Although details thereof will be described below, in the fixed blade 60 according to the embodiment, as shown in FIG. 6, the outflow angle θ2 is smaller than the inflow angle θ1 and is adjacent to the rotational axis direction.

To collect a dynamic pressure, the fixed blade 60 has the above shape such that the air blower 50 changes a movement direction of the air current generated by rotation of the fan 51 toward the rotational axis direction side in a process in which the air current flows in through the inlet end 601 of the fixed blade 60 and flows out through the outlet end 602.

As shown in FIG. 6, in the embodiment, the inflow angle θ1 of the fixed blade 60 subsequently changes according to the radial direction position to correspond to speed distribution of the air current generated by the fan 51 (distribution of the axial direction speed and the circumferential direction speed; refer to FIG. 5).

In detail, at the outer circumferential part and the inner circumferential part in which the axial direction speed of the air current generated by the fan 51 is low and a jet direction of the air current is inclined in the rotational direction X (the circumferential direction), the inflow angle θ1 of the fixed blade 60 is great in comparison to that at the central part in the radial direction. On the other hand, at the central part in the radial direction in which the axial direction speed of the air current generated by the fan 51 is high and a jet direction of the air current is adjacent to the rotational axis direction, the inflow angle θ1 of the fixed blade 60 is great in comparison to that at the outer circumferential part and the inner circumferential part.

In other words, as shown in FIGS. 6 to 7C, an inflow angle θ1*a* at the outer circumferential part of the fixed blade 60 and an inflow angle θ1*c* at the inner circumferential part of the fixed blade 60 are greater than an inflow angle θ1*b* at the central part of the fixed blade 60 in the radial direction ($\theta 1a > \theta 1b$, $\theta 1c > \theta 1b$). Also, the inflow angle θ1 at the fixed blade 60 according to the embodiment is greater than 0°.

As described above, in the air blower 50 according to the embodiment, the inflow angle θ1 of the fixed blade 60 and the jet direction of the air current generated by rotation of the fan 51 correspond to each other such that the air current generated by rotation of the fan 51 easily flows in through the inlet end 601 along the fixed blade 60. Due to this, in the embodiment, when the air current generated by rotation of the fan 51 flows into the fixed blade 60, an inflow resistance is reduced such that a direction of the air current is easily changed by the fixed blade 60. As a result thereof, in contrast to a case in which the configuration is not employed, static pressure efficiency of the air blower 50 may be increased.

Here, in the embodiment, while an innermost part (the inner circumference 60*b*) connected to the inner circumferential connection member 65 of the fixed blade 60 is 0 and an outermost part (the outer circumference 60*a*) connected to the inner wall surface 541 is 100, when a relative position of the fixed blade 60 in the radial direction is shown, the inflow angle θ1 has a minimum value at a part in which a radial direction position (relative value) is 50 to 60 as shown in FIG. 6.

However, the inflow angle θ1 of the fixed blade 60 is not limited to an example shown in FIG. 6 and may be selected according to, for example, the shape of the fan 51, the jet direction of the air current generated by rotation of the fan 51, or the like.

Also, in the embodiment, the outflow angle θ2 of the fixed blade 60 is subsequently changed according to the radial direction position to correspond to the inflow angle θ1 of the fixed blade 60 and the speed distribution of the air current generated by the fan 51.

In detail, as shown in FIG. 6, in the fixed blade 60 according to the embodiment, the outflow angle θ2 is subsequently changed such that the outflow angles θ2 of the inner circumferential part and the outer circumferential part are greater than the outflow angle θ2 of the central part in the radial direction. In other words, even in the embodiment, as shown in FIGS. 6 and 7A to 7C, an outflow angle θ2*a* at the outer circumferential part of the fixed blade 60 and an outflow angle θ2*c* at the inner circumferential part of the fixed blade 60 are greater than an outflow angle θ2*b* at the central part of the fixed blade 60 in the radial direction (θ2*a*>θ2*b*, θ2*c*>θ2*b*).

Also, the fixed blade 60 according to the embodiment, as shown in FIG. 6, the outflow angle θ2 is within a range of greater than 0° and less than or equal to 50° throughout the inner circumferential part and the outer circumferential part.

Also, in the embodiment, a differential (θ1−θ2) between the inflow angle θ1 and the outflow angle θ2 is greater at the outer circumferential part and the inner circumferential part of the fixed blade 60 than at the central part of the fixed blade 60 in the radial direction. In detail, as shown in FIG. 6, a differential Da (=θ1*a*−θ2*a*) at the outer circumferential part of the fixed blade 60 and a differential Dc (=θ1*c*−θ2*c*) at the inner circumferential part are greater than a differential Db (=θ1*b*−θ2*b*) at the central part of the fixed blade 60 in the radial direction (Da>Db, Dc>Db).

In the embodiment, for example, the differential Da at the outer circumferential part of the fixed blade 60 and the differential Dc at the inner circumferential part may be greater than 20°, and the differential Db at the central part of the fixed blade 60 in the radial direction may be less than 20°.

Also, in an example shown in FIGS. 6 to 7C, the differential Da at the outer circumferential part of the fixed blade 60 is greater than the differential Dc at the inner circumferential part of the fixed blade 60 (Da>Dc).

Subsequently, as shown in FIG. 8A, in a cross section taken along the rotational direction X of the fan 51 of the fixed blade 60, a straight line which connects the inlet end 601 with the outlet end 602 is referred to as a chord S.

In the fixed blade 60 according to the embodiment, a chord angle θ3 formed by the chord S and the rotational axis P is subsequently changed according to the radial direction position to correspond to the inflow angle θ1 of the fixed blade 60 and the speed distribution of the air current generated by the fan 51.

In detail, as shown in FIGS. 8A to 8C, in the embodiment, a chord angle θ3*a* at the outer circumferential part of the fixed blade 60 and a chord angle θ3*c* at the inner circumferential part of the fixed blade 60 are greater than a chord angle θ3*b* at the central part of the fixed blade 60 in the radial direction (θ3*a*>θ3*b*, θ3*c*>θ3*b*). Also, the chord angle θ3 at the fixed blade 60 according to the embodiment is greater than 0°.

Also, in the embodiment, a length of the chord S of the fixed blade 60 is subsequently changed according to the radial direction position to correspond to the inflow angle θ1 of the fixed blade 60 and the speed distribution of the air current generated by the fan 51. In detail, as shown in FIGS. 8A to 8C, a length La of a chord Sa at the outer circumferential part of the fixed blade 60 and a length Lc of a chord Sc at the inner circumferential part of the fixed blade 60 are longer than a length Lb of a chord Sb at the central part of the fixed blade 60 in the radial direction (La>Lb, Lc>Lb).

However, in the air blower 50, which includes the fixed blade 60 at the downstream side in the jet direction of the air current caused by the fan 51, when the fixed blade 60 has a shape sharply curved from the inlet end 601 to the outlet end 602, it tends to be difficult for the fixed blade 60 to effectively collect the dynamic pressure. That is, when the fixed blade 60 has the sharply curved shape, an air current which flows in through the inlet end 601 side of the fixed blade 60 may easily become separated from a surface of the fixed blade 60 during a process in which the air current moves toward the outlet end 602 side. When the air current is separated from the fixed blade 60, it becomes difficult for the fixed blade 60 to change a jet direction of the air current, such that is becomes difficult to effectively collect a dynamic pressure of the air current.

As described above, at the fixed blade 60, the outflow angle θ2 is smaller than the inflow angle θ1 to change the jet direction of the air current which flows in through the inlet end 601 side. Also, to reduce an inflow resistance of the air current from the fixed blade 60, the inflow angles θ1 at the inner circumferential part and the outer circumferential part of the fixed blade 60 are greater than that at the central part of the fixed blade 60 in the radial direction. Accordingly, for example, when the outflow angle θ2 and the chord angle θ3 and the length of the chord S of the fixed blade 60 are constant regardless of the radial direction position, the fixed blade 60 easily becomes sharply curved at the inner circumferential part and the outer circumferential part of the fixed blade 60 at which the inflow angles θ1 are greater than that at the central part in the radial direction.

With respect to this, in the fixed blade 60 according to the embodiment, as described above, the outflow angle θ2, the chord angle θ3, and the length of the chord S are changed according to the radial direction position to correspond to the inflow angle θ1 and the speed distribution of the air current generated by the fan 51.

In more detail, in the embodiment, the outflow angle θ2 and the chord angle θ3 at the inner circumferential part and the outer circumferential part of the fixed blade 60 are formed to be greater than the outflow angle θ2 and the chord angle θ3 at the central part of the fixed blade 60 in the radial direction, and the length of the chord S at the inner circumferential part and the outer circumferential part of the fixed blade 60 are formed to be longer than the length of the chord S at the central part of the fixed blade 60 in the radial direction.

The fixed blade 60 has the above configuration such that the fixed blade 60 is suppressed from being sharply curved from the inlet end 601 to the outlet end 602, even at the inner circumferential part and the outer circumferential part of the fixed blade 60 at which the inflow angles θ1 are great.

As a result thereof, in the air blower 50 according to the embodiment, static pressure efficiency of the air blower 50 may be increased since it is possible to effectively collect a dynamic pressure of the air current generated by rotation of the fan 51 using the fixed blade 60, in contrast to a case in which the configuration is not employed.

Also, in the fixed blade 60 according to the embodiment, as described above, the outflow angle θ2 is within a range of greater than 0° and less than or equal to 50° throughout the inner circumferential part and the outer circumferential part (0°<θ2≤50°).

Here, a jet angle of the air current generated by rotation of the fan 51 from the first housing 53 is changed according to a shape of the fan 51 and the like and is generally 60° to 70°. Accordingly, when the outflow angle θ2 is greater than 50°, since a difference between the jet angle of the air current generated by rotation of the fan 51 and the outflow angle θ2 is small, it is difficult to adequately deflect the air current toward the rotational axis direction side.

Also, when the outflow angle θ2 is less than 0°, the jet angle of the air current generated by rotation of the fan 51 and the outflow angle θ2 faces a direction opposite the axial direction. Due to this, when the outflow angle θ2 is less than 0°, the air current generated by rotation of the fan 51 collides with the fixed blade 60 and a loss occurs such that efficiency of collecting the dynamic pressure easily becomes decreased. Also, noise occurs in some cases. Also, when the outflow angle θ2 of the fixed blade 60 is less than 0°, since it is necessary to perform an under-cut process when the fixed blade 60 is manufactured through resin molding, manufacturing costs of the fixed blade 60 increases in some cases.

With respect to this, in the embodiment, the outflow angle θ2 is formed within a range of greater than 0° and less than or equal to 50° such that the air current generated by rotation of the fan 51 may be easily deflected toward the rotational axis direction side in contrast to, for example, a case in which the outflow angle θ2 is greater than 50°. Due to this, in the air blower 50 of the embodiment, it is possible to increase efficiency of collecting the dynamic pressure of the air current generated by rotation of the fan 51, in contrast to a case in which the configuration is not employed.

Also, in the fixed blade 60 of the embodiment, lengths of the chords S at the outer circumferential part and the inner circumferential part are formed to be longer than that at the central part in the radial direction such that lengths of the first surface 60*p* of the fixed blade 60 from the inlet end 601 to the outlet end 602 are long at the outer circumferential part and the inner circumferential part of the fixed blade 60. That is, at the outer circumferential part and the inner circumferential part of the fixed blade 60, in contrast to the central part of the fixed blade 60 in the radial direction, a path through which the air current generated by rotation of the fan 51 is guided by the fixed blade 60 is long.

Due to this, in the air current generated by rotation of the fan 51, even at the outer circumferential part and the inner circumferential part, which have high circumferential direction components, the dynamic pressure of the air current may be effectively collected since it is possible to effectively change the jet direction of the air current, in contrast to a case in which the configuration is not employed.

Meanwhile, as described above, at the central part of the fixed blade 60 in the radial direction, the inflow angle θ1 is smaller than those at the inner circumferential part and the outer circumferential part. Due to this, at the central part of the fixed blade 60 in the radial direction, the outflow angle θ2 and the chord angle θ3 are smaller than those at the inner circumferential part and the outer circumferential part. Due to this, even when a length of the chord S is short, since it is difficult to form the fixed blade 60 to be sharply curved from the inlet end 601 to the outlet end 602, a problem caused by the sharply curved fixed blade 60 rarely occurs.

Also, as described above, at the central part in the radial direction, a proportion of the axial direction component in the air current generated by rotation of the fan 51 is high in comparison to that at the inner circumferential part and the outer circumferential part. In the embodiment, in comparison to the inner circumferential part and the outer circumferential part of the fixed blade 60, the outflow angle θ2 and the chord angle θ3 at the central part of the fixed blade 60 in the radial direction are small and a length of the chord S is short such that the jet direction of the air current at the central part in the radial direction may be changed to be closer to the rotational axis direction side, in contrast to a case in which the configuration is not employed. As a result thereof, static pressure efficiency of the air blower 50 may be increased since it is possible to more effectively collect the dynamic pressure, in contrast to the case in which the configuration is not employed.

Subsequently, a relationship between the fixed blade 60 and the inner wall surface 541 of the second housing 54 in the air blower 50 according to the embodiment will be described. FIG. 9 is a view illustrating a relationship between the fixed blade 60 of Embodiment 1 and the inner wall surface 541 of the second housing 54 and is a view seen in an IX direction in FIG. 3.

As shown in FIG. 9, in the air blower 50 according to the embodiment, the outer circumference 60*a* of each fixed blade 60 is in internal contact with the inner wall surface 541 of the second housing 54. In more detail, as shown in FIG. 9, the outer circumference 60*a* of the fixed blade 60 is in internal contact with the inner wall surface 541 of the second housing 54 from the inlet end 601 to the outlet end 602.

Due to this, in the air blower 50 according to the embodiment, each fixed blade 60 is supported by the inner wall surface 541 of the second housing 54.

Also, in the air blower 50 according to the embodiment, as shown in FIG. 2 described above, the second housing 54 which supports the fixed blade 60 is mounted in the first housing 53. In other words, the inner wall surface 541 of the second housing 54, which supports the fixed blade 60, is connected to the downstream side of the air current in a movement direction at the inner wall surface 531 of the first housing 53, which has a bell mouth shape.

Also, as described above, an inner diameter of the inner wall surface 541 of the second housing 54 is the same as or greater than an inner diameter of the inner wall surface 531 at the downstream side of the air current in the movement direction.

Since the air blower 50 according to the embodiment has a configuration in which the plurality of fixed blades 60 are supported by the inner wall surface 541 of the second housing 54, even when an external force is applied to the fixed blades 60, for example, deformation or damage to the fixed blades 60 is suppressed. Also, since deformation or damage to the fixed blades 60 may be suppressed even when the fixed blades 60 are manufactured using a low-cost manufacturing method such as resin molding and the like, a cost of the air blower 50 may be reduced.

Also, the air blower 50 according to the embodiment has a configuration in which the outer circumference 60*a* of the fixed blade 60 is in internal contact with the inner wall surface 541 of the second housing 54 and the inner wall surface 541 is also connected to the inner wall surface 531 of the first housing 53, such that the air current generated by rotation of the fan 51 is suppressed from leaking toward an outer circumferential side of the fixed blade 60. Due to this, since the jet direction of the air current generated by rotation of the fan 51 may be effectively changed by the fixed blades 60, static pressure efficiency of the air blower 50 may be increased, in contrast to a case in which the configuration is not employed.

Also, in an example shown in FIGS. 2 to 9, the inflow angle θ1 of the fixed blade 60 is subsequently changed according to the radial direction position. However, when a relationship in which the inflow angles θ1 at the inner circumferential part and the outer circumferential part are greater than the inflow angle θ1 at the central part in the radial direction is satisfied, a size of the inflow angle θ1 may be changed in stages according to the radial direction position of the fixed blade 60. Likewise, the outflow angle θ2, the chord angle θ3, a length L of the chord S, and the like of the fixed blade 60 may be changed in stages according to the radial direction position of the fixed blade 60.

Subsequently, Modified Example 1 of the present invention will be described.

FIG. 10 is a view illustrating a configuration of the fixed blade 60, to which Modified Example 1 of Embodiment 1 is applied, and is a view illustrating the fixed blade 60 seen from the rotational axis direction.

In an example shown in FIG. 10, an annular-shaped supporting member 68, to which the plurality of fixed blades 60 are connected and which supports the plurality of fixed blades 60, is included at the central part in the radial direction. Also, in the embodiment, the fixed blades 60 are divided, by the supporting member 68, into a plurality of inner circumferential fixed blades 61 which stretch from the inner circumferential connection member 65 toward the supporting member 68 and a plurality of outer circumferential fixed blades 62 which stretch from the supporting member 68 toward the inner wall surface 541. Also, in the embodiment, the inner circumferential fixed blades 61 have the same shape, and the outer circumferential fixed blades 62 have the same shape.

In the air blower 50 of Modified Example 1, the supporting member 68 is installed at the central part of the fixed blades 60 in the radial direction such that strength of the fixed blades 60 increases in contrast to a case in which the configuration is not employed. Also, since the strength of the fixed blades 60 may be maintained even when the fixed blades 60 are manufactured using a low-cost manufacturing method such as resin molding and the like, a cost of the air blower 50 may be reduced.

Here, like an example shown in FIG. 4 and the like, even in the fixed blades 60 according to the embodiment, shapes of the inner circumferential fixed blades 61 and the outer circumferential fixed blades 62 are subsequently changed to correspond to distribution in the radial direction of speed of the air current generated by rotation of the fan 51. That is, in the embodiment, a shape in which the inner circumferential fixed blades 61 and the outer circumferential fixed blades 62 are connected is the same shape as that of the fixed blades 60 shown in FIG. 4 and the like.

In detail, in the inner circumferential fixed blades 61, in comparison to the supporting member 68 side, the inflow angle θ1 (refer to FIG. 5), the outflow angle θ2 (refer to FIG. 5), and the chord angle θ3 (refer to 8A) are great and the chord S is long at the inner circumferential connection member 65. Also, in the outer circumferential fixed blades 62, in comparison to the supporting member 68, the inflow angle θ1, the outflow angle θ2, and the chord angle θ3 are great and the chord S is long at the inner wall surface 541.

Also, in the fixed blades 60 of Modified Example 1, as shown in FIG. 10, a larger number of the outer circumferential fixed blades 62 than that of the inner circumferential fixed blades 61 are installed. Due to this, for example, in contrast to a case in which the number of the inner circumferential fixed blades 61 and the number of the outer circumferential fixed blades 62 are the same, a gap between the outer circumferential fixed blades 62 is suppressed from being excessively increased. As a result thereof, even in an outer circumferential side of the fixed blades 60 (the outer circumferential fixed blades 62), it is possible to effectively change the jet direction of the air current generated by rotation of the fan 51 such that the dynamic pressure may be more effectively collected in comparison to a case in which the configuration is not employed.

Also, in an example shown in FIG. 10, although the fixed blade 60 is divided into two areas (the inner circumferential fixed blade 61 and the outer circumferential fixed blade 62) by one supporting member 68, for example, a plurality of such supporting members 68 may be installed in the radial direction to divide the fixed blade 60 into three ore more areas. In this case, in each of the three or more areas, the number of the fixed blades 60 or the gap between the fixed blades 60 may be changed.

Subsequently, Modified Example 2 of the present invention will be described.

FIGS. 11A and 11B are views illustrating a configuration of the fixed blade 60 to which Modified Example 2 of Embodiment 1 is applied. Here, FIG. 11A is a view of the fixed blades 60 seen in a direction inclined with respect to the rotational axis direction, and FIG. 11B is a cross-sectional view taken along XIB-XIB in FIG. 11A.

An example shown in FIGS. 11A and 11B has a configuration in which the outer circumferences 60*a* of the plurality of fixed blades 60 are connected by a ring-shaped outer circumferential connection member 66. In detail, as shown in FIG. 11A, the outer circumference 60*a* at the second surface 60*q* of the plate-shaped fixed blade 60 is connected to the outer circumference 60*a* at the first surface 60*p* of the fixed blade 60 adjacent to the fixed blade 60 and the rotational direction X of the fan 51.

Also, although not shown in the drawing, in the air blower 50 (refer to FIG. 2) to which the fixed blade 60 of Modified Example 2 is applied, the outer circumferential connection member 66 which connects the plurality of fixed blades 60 is mounted at the downstream side of the air current in the movement direction in the first housing 53 (refer to FIG. 2).

In Modified Example 2, a configuration in which the outer circumferences 60*a* of the plurality of fixed blades 60 are connected by the outer circumferential connection member 66 is employed such that deformation or damage to the fixed blades 60 may be suppressed, for example, even when an external force is applied to the fixed blades 60. Also, since deformation or damage to the fixed blades 60 may be suppressed even when the fixed blades 60 are manufactured using a low-cost manufacturing method such as resin molding and the like, a cost of the air blower 50 may be reduced.

Also, the outer circumferential connection member 66 may provide the same effect even when in external contact with the outer circumferences 60*a* of the fixed blades 60 from the outer circumferential side in the radial direction.

Embodiment 2

Subsequently, Embodiment 2 of the present invention will be described. Also, in a following description, components the same as those of Embodiment 1 will be referred to using the same reference numerals and a detailed description thereof will be omitted.

FIG. 12 is a view illustrating changes of an inflow angle θ1 and an outflow angle θ2 of a fixed blade 60 to which Embodiment 2 is applied, according to radial direction positions. Also, FIGS. 13A to 14C are views illustrating shapes of a cross section of the fixed blade 60 to which Embodiment 2 is applied and illustrating shapes of the cross section of the fixed blade 60 according to the rotational direction X of a fan 51. Here, FIGS. 13A and 14A correspond to cross-sectional views of the fixed blade 60 at an outer circumferential part (a radial direction position 100), FIGS. 13B and 14B correspond to cross-sectional views of the fixed blade 60 at a central part (a radial direction position 50), and FIGS. 13C and 14C correspond to cross-sectional views of the fixed blade 60 at an inner circumferential part (a radial direction position 0).

The fixed blade 60 to which Embodiment 2 is applied has a size according to the radial direction position of the outflow θ2, which is different from that of the fixed blade 60 to which Embodiment 1 is applied.

That is, as shown in FIGS. 12 to 13C, the fixed blade 60 to which Embodiment 2 is applied has an outflow angle θ2 of an approximately uniform size from the inner circumferential part to the outer circumferential part. In other words, in Embodiment 2, the outflow angle θ2*a* at the outer circumferential part of the fixed blade 60, the outflow angle θ2*b* at the central part of the fixed blade 60 in the radial direction, and the outflow angle θ2*c* at the inner circumferential part of the fixed blade 60 have approximately the same size ($\theta 2a \approx \theta 2b \approx \theta 2c$).

Here, in the embodiment, "the size of the outflow angle θ2 is approximately uniform" means that a difference between a maximum value and a minimum value of the outflow angle θ2 from the inner circumferential part to the outer circumferential part of the fixed blade 60 is less than 10°.

Also, as shown in FIG. 12, the fixed blade 60 to which Embodiment 2 is applied has an outflow angle θ2 within a range of greater than 0° and less than or equal to 50° from the inner circumferential part to the outer circumferential part ($0° < \theta 2 \leq \leq 50°$).

Also, as shown in FIG. 12, the fixed blade 60 to which Embodiment 2 is applied has an outflow angle θ2 smaller than the inflow angle θ1 throughout, from the inner circumferential part, the central part in the radial direction, and to the outer circumferential part.

In Embodiment 2, the outflow angle θ2 of the fixed blade 60 is approximately uniform from the inner circumferential part to the outer circumferential part such that a jet direction of an air current which is deflected by the fixed blade 60 and discharged becomes approximately uniform from the inner circumferential part to the outer circumferential part of the fixed blade 60. Due to this, for example, in contrast to a case in which the outflow angle θ2 is changed according to the radial direction position, disorder of the air current discharged from the fixed blade 60 is suppressed. As a result thereof, in the air blower 50 to which the fixed blade 60 according to the embodiment is applied, the occurrence of noise is suppressed.

Also, in Embodiment 2, like in Embodiment 1, the inflow angle θ1*a* at the outer circumferential part of the fixed blade 60 and the inflow angle θ1*c* at the inner circumferential part of the fixed blade 60 are greater than the inflow angle θ1*b* at the central part of the fixed blade 60 in the radial direction ($\theta 1a > \theta 1b$, $\theta 1c > \theta 1b$). In other words, Embodiment 2, like Embodiment 1, has a relationship in which the inflow angle θ1 of the fixed blade 60 corresponds to the jet direction of the air current generated by rotation of the fan 51 (refer to FIG. 2).

Accordingly, like in Embodiment 1, in the air blower 50 to which the fixed blade 60 of Embodiment 2 is applied, the air current generated by rotation of the fan 51 easily flows in through the inlet end 601 along the fixed blade 60. Due to this, like in Embodiment 1, when the air current generated by rotation of the fan 51 flows into the fixed blade 60, an inflow resistance is reduced such that a direction of the air current is easily changed by the fixed blade 60. As a result thereof, even in Embodiment 2, static pressure efficiency of the air blower 50 may be increased.

Also, in Embodiment 2, like in Embodiment 1, the chord angle θ3*a* at the outer circumferential part of the fixed blade 60 and the chord angle θ3*c* at the inner circumferential part of the fixed blade 60 are greater than the chord angle θ3*b* at the central part of the fixed blade 60 in the radial direction ($\theta 3a > \theta 3b$, $\theta 3c > \theta 3b$).

Also, in Embodiment 2, the length La of the chord Sa at the outer circumferential part of the fixed blade 60 and the length Lc of the chord Sc at the inner circumferential part of the fixed blade 60 are longer than the length Lb of the chord Sb at the central part of the fixed blade 60 in the radial direction (La>Lb, Lc>Lb).

Due to this, even in Embodiment 2, like in Embodiment 1, in the air current generated by rotation of the fan 51, the dynamic pressure of the air current may be effectively collected at the outer circumferential part and the inner circumferential part, which have high circumferential direction components, since it is possible to effectively change the jet direction of the air current.

Also, although not shown in the drawing, like in Embodiment 1, the supporting member 68 shown in FIG. 10 or the outer circumferential connection member 66 shown in FIG. 11 may also be applied to the fixed blade 60 of Embodiment 2.

As described above, in the air blower 50 to which the present invention is applied, the plurality of fixed blades 60 have a shape changed according to the radial direction position to correspond to the jet direction of the air current generated by rotation of the fan 51. Due to this, speed energy (a dynamic pressure) in the circumferential direction of the air current generated by rotation of the fan 51 may be effectively collected by the plurality of fixed blades 60. As a result thereof, in the embodiment, in contrast with a case in which the configuration is not employed, static pressure efficiency of the air blower 50 may be increased. Also, in the embodiment, in contrast with a case in which the configuration is not employed, noise generated by the air current at the air blower 50 may be reduced.

The invention claimed is:

1. An air conditioner including an outdoor unit comprising:

an air blowing fan which rotates around a rotational axis;

an air blowing fan housing which covers the air blowing fan; and at least one fixed blade which extends radially from the rotational axis of the air blowing fan toward an inner wall surface of the air blowing fan housing and comprises a curved shape curved along a radial direction of the air blowing fan, wherein:

the at least one fixed blade comprises:

an inlet end disposed at a first side into which an air current formed by the air blowing fan flows, an outlet end disposed at a second side through which the air current flows out along the at least one fixed blade, an inner circumferential part disposed proximate to the rotational axis, an outer circumferential part disposed farther away from the rotational axis than the inner circumferential part and the inner wall surface of the air blowing fan housing, and a central part disposed between the inner circumferential part and the outer circumferential part, first inflow angles formed by the inlet end and the rotational axis at the inner circumferential part and the outer circumferential part are greater than a second inflow angle formed by a tangent of the inlet end and the rotational axis at the central part, and first chord angles formed by the rotational axis and first chords which connect the inlet end with the outlet end at the inner circumferential part and the outer circumferential part are greater than a second chord angle formed by the rotational axis and a second chord which connects the inlet end with the outlet end at the central part.

2. The air conditioner of claim 1, wherein an outflow angle formed by the outlet end and the rotational axis is between 0° and 50°.

3. The air conditioner of claim 1, wherein first outflow angles formed by the outlet end and the rotational axis at the inner circumferential part and the outer circumferential part are greater than a second outflow angle formed by the outlet end and the rotational axis at the central part.

4. The air conditioner of claim 1, wherein an outflow angle formed by the outlet end and the rotational axis maintains a uniform angle along the inner circumferential part to the outer circumferential part.

5. The air conditioner of claim 1, wherein an outflow angle formed by the outlet end and the rotational axis is greater than the first inflow angles and the second inflow angle.

6. The air conditioner of claim 1, wherein lengths of the first chords are longer than a length of the second chord.

7. The air conditioner of claim 1, wherein the curved shape is formed to be curved along the radial direction of the air blowing fan and in a direction opposite a rotation direction of the air blowing fan.

8. The air conditioner of claim 1, further comprising an inner circumferential connection member disposed on the rotational axis, provided to come into contact with the inner circumferential part of the at least one fixed blade and a supporting member disposed between the inner circumferential connection member and the inner wall surface of the air blowing fan housing, and provided to have an annular shape.

9. The air conditioner of claim 8, wherein the the at least one fixed blade comprises a plurality of fixed blades, wherein the plurality of fixed blades comprise a plurality of first fixed blades which radially extend between the inner circumferential connection member and an outer circumferential member and a plurality of second fixed blades which radially extend between the supporting member and the inner wall surface of the air blowing fan housing, and wherein a number of the plurality of second fixed blades is larger than a number of the plurality of first fixed blades.

* * * * *